United States Patent [19]

Nishiyama et al.

[11] 4,353,142

[45] Oct. 12, 1982

[54] MOP CARRIER AND A ROTARY SUPPRESSOR THEREIN

[75] Inventors: Masanobu Nishiyama, Osaka; Yasuhiro Kiuchi, Minoo, both of Japan

[73] Assignee: Duskin Franchise Kabushiki Kaisha, Osaka, Japan

[21] Appl. No.: 157,982

[22] Filed: Jun. 9, 1980

[30] Foreign Application Priority Data

Jan. 25, 1980 [JP] Japan ..... 55-7711[U]

[51] Int. Cl.[3] ..... A47L 13/254

[52] U.S. Cl. ..... 15/144 R; 15/147 A; 15/229 A; 403/388; 24/204

[58] Field of Search ..... 15/229 R, 229 A, 229 AW, 15/229 BW, 228, 144 R, 147 A, 231, 230, 230.12, 230.17; 24/204, 306; 403/388, 152, 161

[56] References Cited

U.S. PATENT DOCUMENTS

| | | | |
|---|---|---|---|
| 3,295,155 | 1/1967 | Belsky | 15/228 X |
| 3,302,232 | 2/1967 | Wasiloff | 15/230.17 |
| 3,346,904 | 10/1967 | Armstrong | 15/230.12 |
| 3,360,286 | 12/1967 | Smyth | 15/147 A X |
| 3,590,414 | 7/1971 | Gores | 15/244 R |
| 3,703,739 | 11/1972 | Young | 15/230.17 |
| 3,778,860 | 12/1973 | Thielen | 15/147 A |
| 3,792,505 | 2/1974 | Saltzstein | 15/147 A X |
| 3,996,639 | 12/1976 | Griffin | 15/231 |

FOREIGN PATENT DOCUMENTS

| | | | |
|---|---|---|---|
| 2419215 | 10/1975 | Fed. Rep. of Germany | 15/229 A |

*Primary Examiner*—Billy J. Wilhite

*Attorney, Agent, or Firm*—Cushman, Darby & Cushman

[57] ABSTRACT

A floor mop or the like is shown including a mop removably, replaceably mounted to a mop carrier, for instance using conventional Velcro hook and fleece fasteners. The mop carrier is pivotally mounted to a mop handle via a bearing arrangement that includes sleeves on the carrier and handle, pinned together with a pivot pin that is non-rotatable relative to the carrier but which provides for a limited degree of rotation of the mop carrier relative to the mop handle upon overcoming a moderate degree of friction between the pivot pin and mop handle bearing barrel that results from a snut fit between specially contoured surfaces of these two members.

13 Claims, 33 Drawing Figures

MOP CARRIER AND A ROTARY SUPPRESSOR THEREIN

FIELD OF THE INVENTION

This invention relates to a mop carrier, to a mop handle and a rotary movement regulator.

DESCRIPTION OF THE PRIOR ART

Conventional mops having a mop carrier are sometimes provided with an engagement means which engages the mop to the carrier, said engagement means sometimes being a string which ties the mop to the mop carrier. However, such engagement is inconvenient. It is also conventional to provide a universal joint between the mop and a mop handle in the form of a bolt and a nut so as to permit the user to change the connection power in a thrust direction thereby controlling rotary torque. However, this conventional joint provides non-uniform control of the torque.

SUMMARY OF THE INVENTION

To overcome these drawbacks, the present invention provides a novel mop carrier and a novel rotary movement regulator between the mop carrier and a mop handle. One of the objects of this invention is to construct the mop carrier so as to provide a quick and snug securement of the mop thereto with an aid of a Velcro hook and fleece-type fastener. Another object of this invention is to provide a rotary movement regulator for regulating rotary movement of the mop carrier relative to the mop handle.

The mop carrier of the present invention comprises an elongated ellipsoidal frame, pivotably mounted at the lower end of the mop handle, an inner plate integrally fitted to the frame a first hook and fleece-type fastener member provided between the frame and the plate, and a support frame which sandwiches the first hook and fleece-type fastener member against the inner plate.

The rotary movement regulator of the present invention comprises an axial member and an annular ring member frictionally fit around this axial member, said axial member having a plurality of circumferential projections axially spacedly provided thereon, with at least one of circumferential groove among them.

DESCRIPTION OF THE PREFERRED EMBODIMENTS

Figure 1:
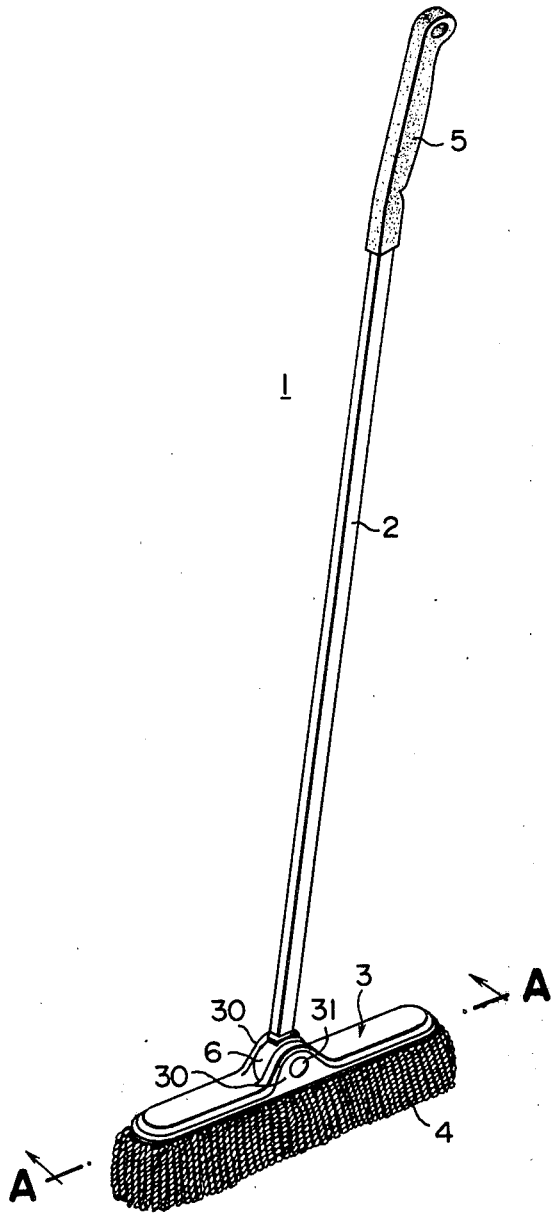
FIG. 1 is a perspective view of an entire mop assembly incorporating the carrier and rotary movement regulator of the present invention.
Figure 2:
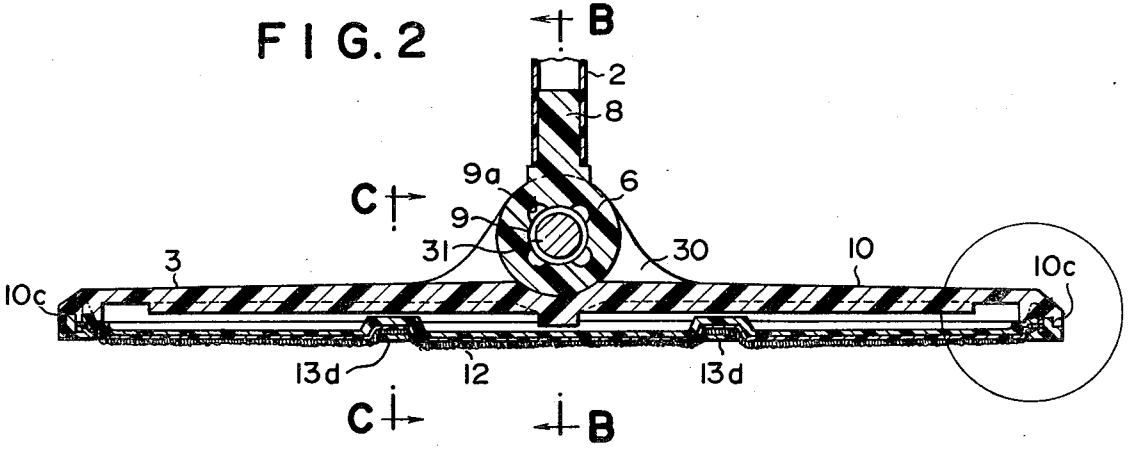
FIG. 2 is a partial enlarged cross section along line A—A of FIG. 1 with the mop itself omitted.

Now, the preferred embodiments according to this invention will be hereinafter discussed with reference to the accompanying drawings.

The mop carrier 1 of this first embodiment is characterized by having either the male hook part or female fleece part of a Velcro fastener or the like fixed on the bottom surface of the mop carrier frame 3 which is rotatably mounted at the lower end of the mop handle 2. The other one of the Velcro fasteners or the like 34 is fixed on an upper surface of the mop itself, so that the mop is detachably mounted, the mop carrier frame is a simple construction that is easy to produce and also a snug fit of the fastener 12, 34 is accommodated on the under-side of the carrier.

The mop carrier 1 comprises the handle, handle portion or stem 2 and the mop carrier frame 3 rotatably pivoted at a lower end of the handle. The mop 4 is detachably mounted on the lower face of the mop carrier frame 3.

The handle stem 2 is made in a convenient length of a pipe, which is either rectangular or circular in cross section, at a top end of which is integrally provided a grip 5 made of, for example, synthetic resin or hard rubber. A bearing barrel member 6 is secured at a lower end of the handle stem 2. The bearing barrel member 6 is formed in a cylindrical shape from synthetic resin or hard rubber, at a sidewall surface of which is formed a boss-like square projection 7, at the center of which is provided a square sectioned socket 8 having a slightly smaller size than the lowest end of the handle stem 2.

Provided at a center of the bearing barrel member 6 and extending along in a generally horizontal side-to-side direction is a bore 9, at circumference of which is provided a plurality of axial grooves 9*a* having a semi-circular transverse cross section. An axial ridge or ridges each having a slight radially inward projection may be formed on the circumferential surface of the bore 9 as an alternative to providing the grooves 9*a*.

The axial length of the thus-formed bearing barrel member 6 is such that this bearing barrel member is rotatably journalled by the bearing pin 31 on the support plane of the mop carrier frame 3 which will be described later in detail.

The mop carrier frame 3 comprises a base plate 10, an inner plate 11, a mop fastener 12 and the support frame 13, as shown in FIGS. 7–10.

Figure 7:
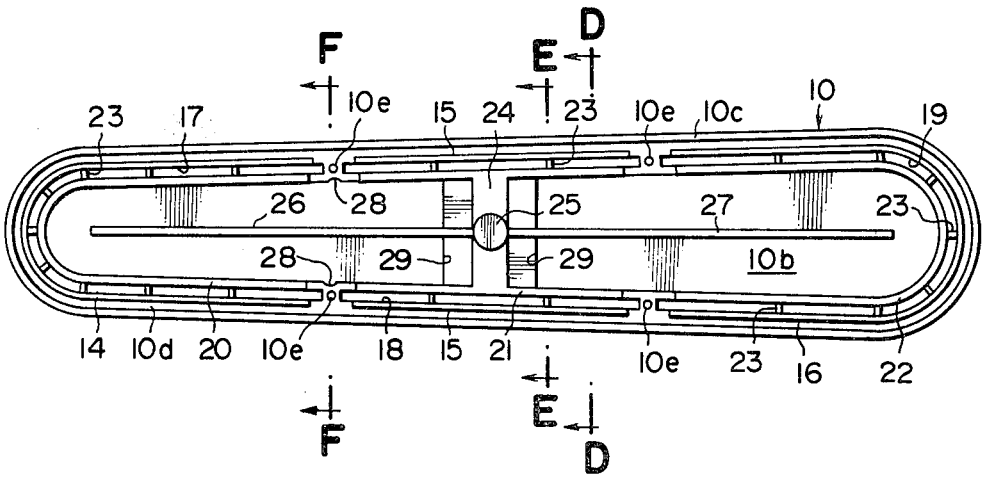
FIG. 7 is a bottom plan view of the base plate.
Figure 8:
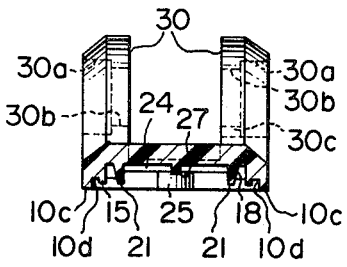
FIG. 8 is a cross section along line D—D of FIG. 7.
Figure 9:
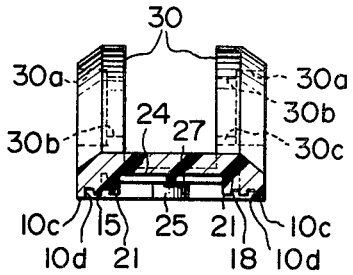
FIG. 9 is a cross section along line E—E of FIG. 7.
Figure 10:
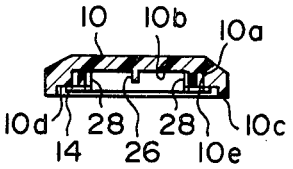
FIG. 10 is a cross section along line F—F of FIG. 7.

The base plate 10 is generally formed as a generally flat and elongated ellipsoidal-shaped frame, an upper surface of which is generally flat and has formed along the perimeter thereof a shoulder of which is a chamfer 10*a*. Centrally formed in the underside of the base plate 10 is a recess 10*b* of the same ellipsoidal shape as the plate 10, but being a little smaller. The base plate 10 although generally of elongated ellipsoidal shape has a diameter at its one end that is smaller than that of its other end. In FIG. 7, the larger diameter rear end is at the right and the smaller diameter front end is at the left.

Formed on the bottom surface of the base plate 10 surrounding the recess 10*b* is a flange 10*c* having a definite width and which is flush with the outer peripheral side wall of the plate, along the whole perimeter. Provided inside of the flange 10*c* is a groove 10*d* along the whole perimeter, the same as the flange 10*c* is. Formed apart from this flange 10*c* at discontinued left, right and center points, are ridges 14, 15, 16, height of which is lower than that of the flange 10*c* and a bore 10*e* is provided between the ridges 14, 16, the outer ends whereof being formed in arcuate shapes, and the ridge 15 being formed at the center.

Similarly, three discontinuous grooves 17–19 are provided inside of the ridges 14–16. These grooves are similar to the ridges 14–16, but are slightly longer.

Provided inside of the grooves 17–19 are three discontinuous ridges 20–22 in left, right and center portions, similarly to the grooves 17–19. Formed between these ridges 20–22 and the ridges 14–16 are a plurality of partition walls 23 which project vertically down from the bottom of the base plate 10, traversing the grooves 17–19, with a uniform spacing between adjacent partition walls.

The ridge 21 at the center includes a bridge 24 traversing the center of the ellipsoidal recess 10*b*. However, the ridge 21 has an essentially equal extent of vertical dependency with the ridge 15 and less vertical dependency than the outermost circumference ridge 10*c*, but the bridge 24 has a vertical dependency less than the ridge 21. Formed at the center of the bridge 24 is a low cylindrical downward projection 25 having the same vertical dependency as the outermost ridge 10*c*. Bracketing this projection 25, ridges 26, 27 having a generally similar vertical dependency as the bridge 24 are formed in the axial direction widthwise of the dent 10*b*. These ridges 26, 27 each at both ends are positioned at the center of the arcuate position forming the both ends of the recess 10*b*.

To this end, the diameters of the bore 10*e* and the perimetrical wall are arranged to be generally identical such that a partial walling of the recess 10*b* of the back surface of the base plate 10 is formed near the bore 10*e* formed between the grooves 17 and 18. A semi-circular recess 28 is formed toward inside. Formed at both sides of the bridge 24 are grooves 29 having a definite width slightly deeper than the recess 10*b* so as to traverse the recess 10*b*.

Support plates 30 protrude in opposite relation on the upper surface of the base plate 10 and both sides of its center. These support plates 30 are formed at the top in arcuate shape, and each diverges at its base and continues to the upper surface of the base plate 10, describing a loose curve and the cylindrical portion of its top has an essentially identical diameter with that of the bearing barrel member 6. Formed at the outer surface of the support plates 30 are bores 30*a* having large diameter until these reach almost the center of the thickness of the plates, and formed continuous therefrom are bores 30*b* having small diameters and a notch 30*c* is formed in a part of these small bores 30*b*.

Figure 4:
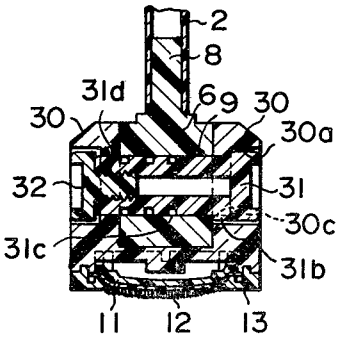
FIG. 4 is a partial enlarged cross section along line B—B of FIG. 2.
Figure 3:
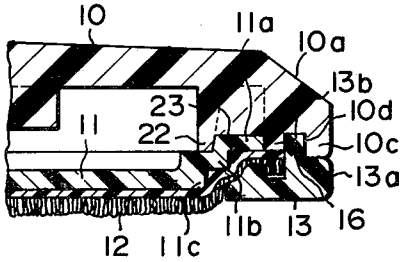
FIG. 3 is a partial enlarged cross section of the portion encircled in FIG. 2.
Figure 5:
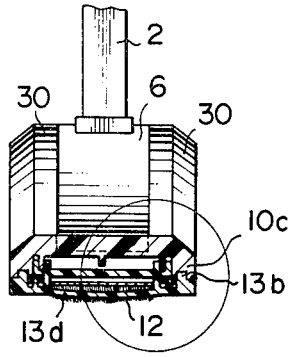
FIG. 5 is a partial enlarged cross section along line C—C of FIG. 2.
Figure 6:
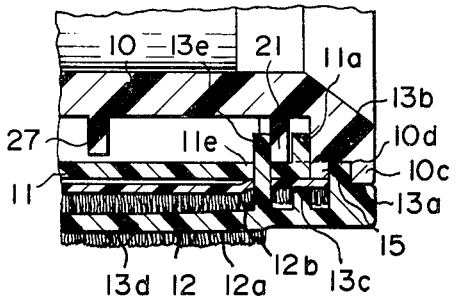
FIG. 6 is a partial enlarged cross section of the part encircled in FIG. 5.
Figure 19:
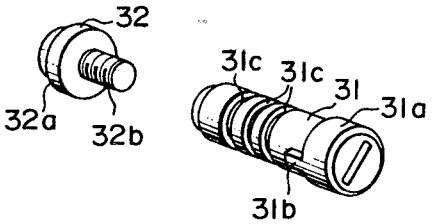
FIG. 19 is a perspective view showing the bearing pin member.

Inserted into the bores 30*a*, 30*b* are a pair of axial members 31, 32 (FIG. 19) journalling the bearing barrel 6 as shown in FIG. 4. The bearing pin 31 is formed with a hollow as shown in FIG. 19 and has a length which reaches to the bore 30*b* from another bore 30*a* and is formed at its head a large diameter member 31*a*, with which a projection 31*b* is integrally formed flush therewith, toward the tip end of axial pin member 31. The projection has a size to be mated within the notch formed at the bore 30*b* of the support plate 30.

Three axially spaced ring-shaped grooves 31*c* are formed generally at the center of the axial pin member 31, and upon insertion of this axial pin member 31 within the bearing barrel member 6 as shown in a cross section of FIG. 4, the grooves 31*c* reduce the contact area of the axial pin member 31 with the periphery of the bore 9 of the bearing barrel member 6. This reduces frictional resistance with the bore 9 of the bearing barrel member 6. If, instead, a plurality of axial ridges having a slight radially inward projection are formed on the periphery and no grooves 9*a* are formed, the contact area is further reduced thereby assuring a less stiffly regulated rotation of the bearing barrel member 6.

Another axial member 32 is provided; it has a head 32*a* having a relatively large diameter as shown in FIG. 19, which is identical with the large diameter portion 31*a* of the axial member 31 and identical with the bore 30*a* formed through the support plate 30. Formed integrally inside of the head 32*a* is a screw-threaded shank 32*b*, which in use is threaded with a female thread 31*d* formed at a tip end of the axial pin member 31.

These axial members 31, 32 are inserted into the bore 9 of the bearing barrel member 6 and mated between the support plates 30, 30 through the bores 30*a*, 30*b* of the one of the support plates 30, as shown in a cross section of FIG. 4. At the same time, the projection 31*b* of the axial pin member 31 is mated within the notch 30*c* formed at the bore 30*b* of the support plate 30. Therefore, the axial pin member 31 is not rotated with a rotation of the bearing barrel member 6. The bearing member 32 is mated within the female thread 31*d* through the bores 30*a*, 30*b* of the support plate 30 by mating its screw-threaded shank 32*b* and the bearing barrel member 6 is rotatably pivoted with respect to the support plates 30, 30 and hence the mop carrier frame 3.

Rotation of the bearing barrel member 6, hence of the handle stem 2 is limited only in a lengthwise direction of the mop carrier frame 3, since the axial members 31, 32 are attached so as to traverse across the center in the axial direction of the mop carrier frame 3.

Figure 11:
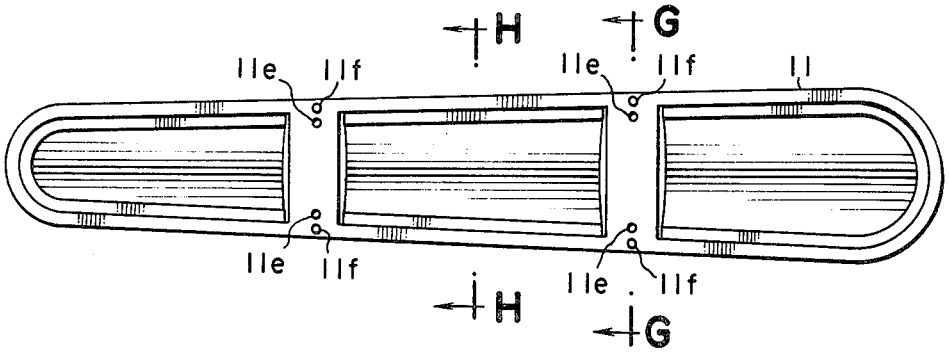
FIG. 11 is a bottom plan view of the inner plate.
Figure 12:
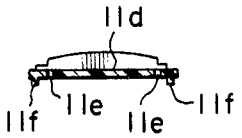
FIG. 12 is a cross section along line G—G of FIG. 11.
Figure 13:
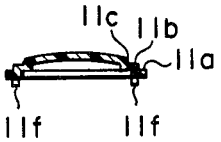
FIG. 13 is a cross section along line H—H of FIG. 11.
Figure 14:
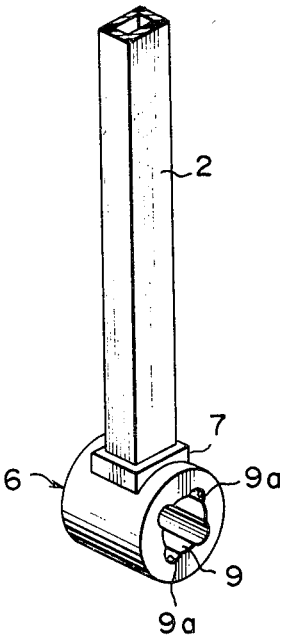
FIG. 14 is a fragmentary perspective view of the mop handle showing the bearing barrel member thereof.
Figure 15:
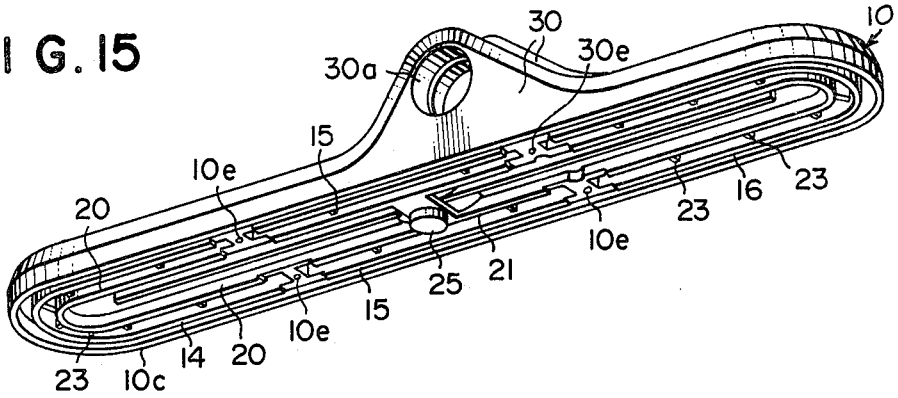
FIGS. 15–18 are respectively perspective views, showing the base frame, the inner plate, the first hook and fleece-type fastener member and the support frame.
Figure 16:
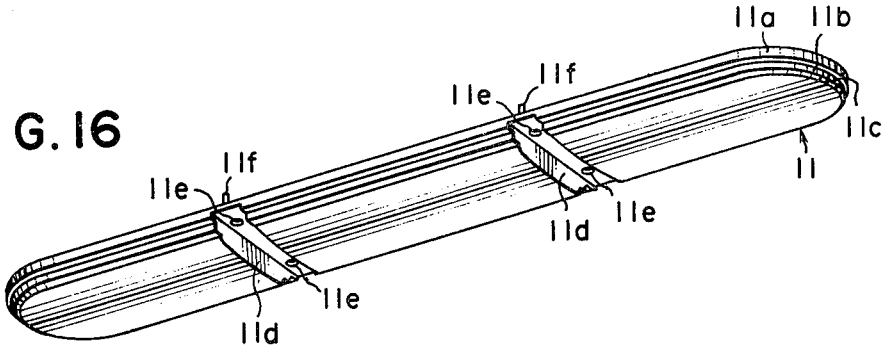

The inner plate 11 is formed so as to have a flat ship shape as shown in FIG. 16 and has a size essentially similar to the inner size of the ridges 17–19 formed at the bottom surface of the base plate. As a whole the inner plate 11 has an elongated ellipsoidal shape and its cross section is generally arcuate. This inner plate 11 has three stages of thickness, so that it becomes gradually smaller toward downward at its outer periphery and the outer periphery of the highest stage 11*a* is identical in size with that of inner side of the ridges 17–19 at the center formed at the bottom of the base plate 10. The central stage 11*b* and the lowest stage 11*c* relate to the frame 13 as described in more detail hereinbelow. Formed from the outer periphery of the inner plate 11 and dividing it nearly in three in the lengthwise direction are recesses 11*d* with a definite width traversing the plate 11. The depth of the recesses 11*d* is generally identical with the bottom face of the stage 11*a* and bores 11*e*, 11*e* are respectively formed near both ends of each recess 11*d*. Pins 11*f* protrude upwardly on the upper surface of the inner plate 11 and also outside of the bores 11*e* as shown in FIG. 11. These pins 11*f* are inserted into the bores 11*e* formed on the bottom face of the base plate and the stage 11*a* contacts the separator wall 23 formed transversely between the ridges 17–19 and 20–22 formed on the bottom face of the base plate 10.

Figure 17:
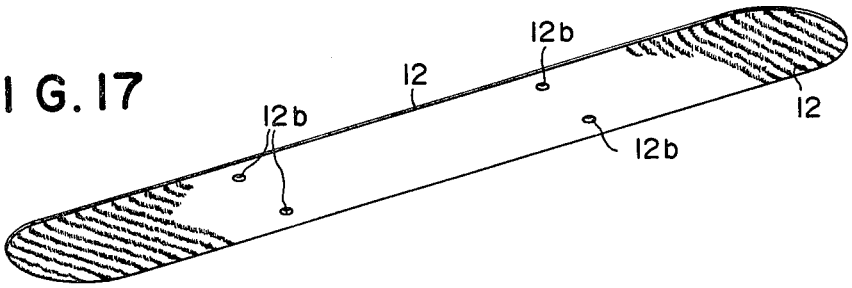

One part of a hook and fleece-type fastener 12, formed an elongated ellipsoidal shape as shown in FIG. 17 and having a size generally identical with the lowest stage 11*c* of the inner plate is juxtaposed on the lower side of the inner plate 11 with its fastening means 12*a* presented downwards. This fastener 12 is provided with bores 12*b* respectively at positions in opposition to the bores 11*e* formed through the recesses 11*d* of the inner plate as shown in FIG. 17.

Figure 18:
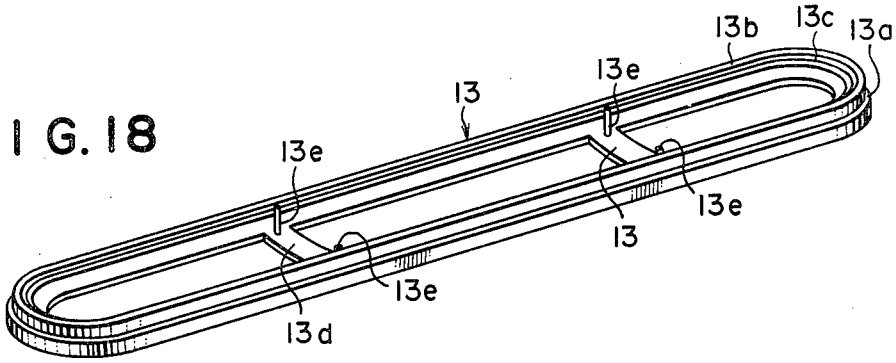

The support frame 13 is formed so as to have an elongated ellipsoidal shape as shown in FIG. 18. This support frame 13 has a stage 13*a* at the outermost periphery thereof and this stage 13*a* is positioned so that it contacts the ridge 10*c* at the outermost periphery of the bottom surface of the base plate 10. Formed inside of the stage 13*a* and on the whole upper periphery is a ridge 13*b*, which is inserted within the ridge 10*d* between the ridge 10*c* on the outer periphery of the base plate 10 and the ridges 14–16 at the center. Formed inside of the ridge 13*b* is a ridge 13*c* slightly lower than the outermost stage 13*a*. A small gap is thus provided between the ridge 13*c* and the ridge 13*b*.

Formed intermediate the ends of the support frame 13 at positions that divide it in three in a lengthwise direction, at the positions corresponding to the concaves 11*d*, traversely are two bridges 13*d*, the width of each of which is essentially identical with that of the respective recess 11*d*. Upwardly protruding near both ends of these bridges 13*d* are pins 13, each for insertion within the bore 12*b* of the fastener 12 and the bore 11*e* of the inner plate.

Figure 20:
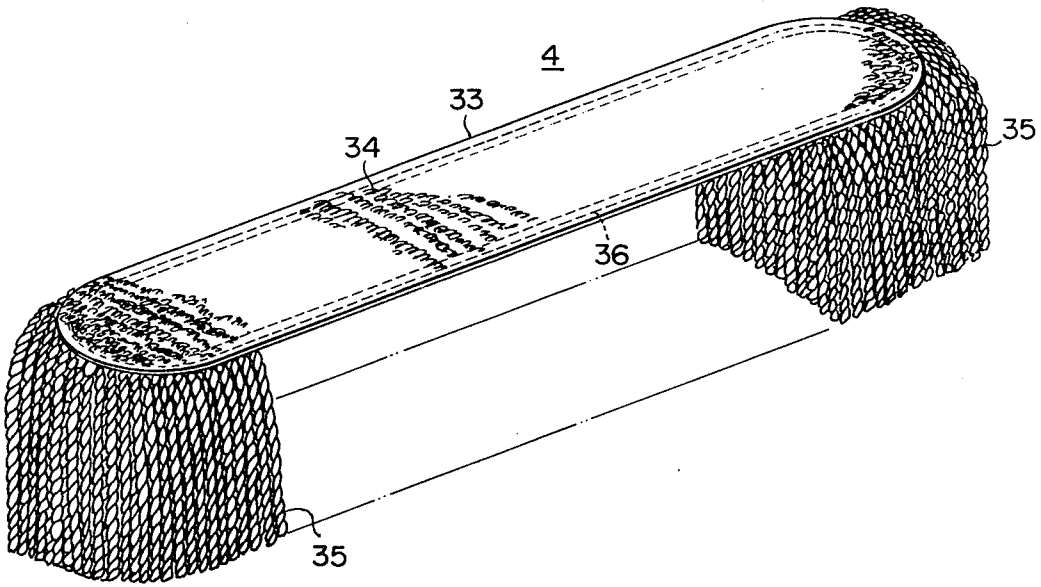
FIG. 20 is an enlarged perspective view of the mop itself.

FIG. 20 further shows the mop 4 per se. It is shown including a base cloth 33 formed in a shape generally identical with the fastener 12 and the other part of a conventional hook and fleece-type cloth fastener 34 is formed on the upper surface of the base 33. Secured by sewing at the folded portions on the bottom surface of the base cloth 33 and doubled-over are mop strings 35 which, considered collectively, form the elongated ellipsoidal mop 4.

Now, a method for assembly of the carrier will be described in detail.

The inner plate 11 is first attached to the base plate 10. At this moment, the pins 11*f* of the inner plate are inserted through the bores 10*e* of the base plate 10 and the upper surface of the uppermost stage 11*a* contacts the partition wall 23 formed between the ridges 14–16 at the center of the base plate 10 and the innermost ridges 20–22. In this condition, the base plate 10 and the inner plate 11 are contacted and the fastener 12 is attached on the backside of the inner plate 11.

At this moment, the bores 12*b* of the fastener 12 and the bores 11*e* of the recesses are urged to be in opposition. The pins 13*e* are inserted through the bores 12*b* of the fastener 12 and the bores 11*e* of the inner plate 11 and pins then are positioned outside the peripheral wall of the recess 10*b* near the bores 10*e* and the semicircular recesses 28 formed near the bores 10*e* of the base plate 10. At this moment, the outermost stage 13*a* of the support frame 11 contacts the end face of the outermost ridge 11 of the base plate 10. Simultaneously, the innermost ridge 13*c* of the support frame 13 presses the outer periphery of the fastener 12, at the outside of the pin 13*e*. In this state, a sonic welding device is used to integrate each contact part of the base plate 10, the inner plate 11 and the support frame 13 and at the same time the fastener 12 is semi-permanently secured therewith and integrated to provide the mop carrier frame 3.

In this state, the fastener elements, e.g. hooks 12*a* on the bottom of the fastener 12 are faced downward, from the part except at the bridges 13*d* of the support frame 13. Because the area of the hooks fastener elements e.g. 12*a* facing downward is a relatively large area, upon engaging the complementary hook or fleece elements, e.g. fleece of the fastener 34 formed on the upper surface of the base cloth 33, the mop is surely detachably attached by the fastener 12 to the mop carrier frame 3.

Thus, a low-cost and convenient mop carrier is provided which may be assembled entirely by supersonic welding and means to permit easy detachment and attachment of the mop are provided.

Now the rotary motion regulator according to this invention will be hereinafter described in detail.

The rotary joint for rotatably joining the mop and carrier frame comprises an axial pin member and a ring, this axial pin member having a plurality of circumferential projections provided axially spaced at a certain distance to each other with at least one of circumferential groove among them, this ring member having a plurality of projections circumferentially positioned at a certain distance and extending axially, and a plurality of noses, this axial pin member and this ring member being frictionally engaged thereby supporting a free rotation thereof, said frictional engagement being made with 0.45–0.9 kg cm therebetween.

Figure 21:
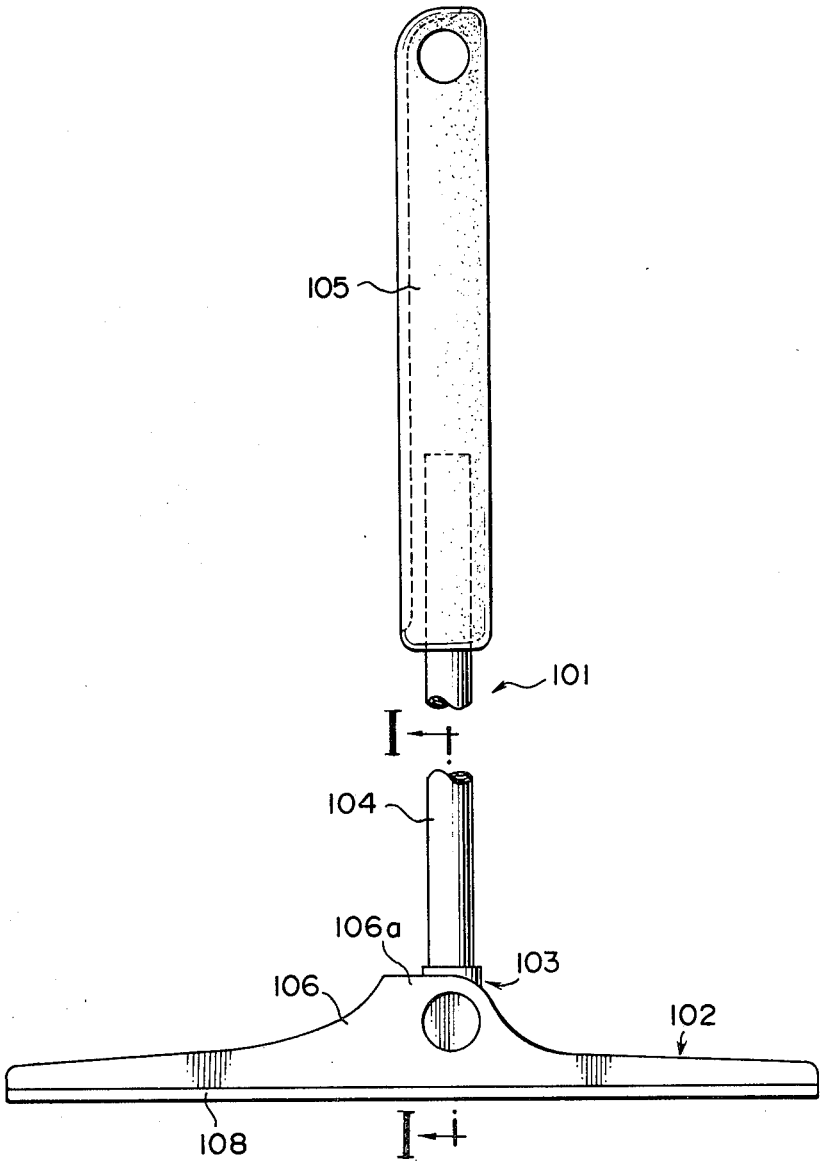
FIG. 21 is a left side elevational view of the mop carrier and handle assembly of a second embodiment.
Figure 22:
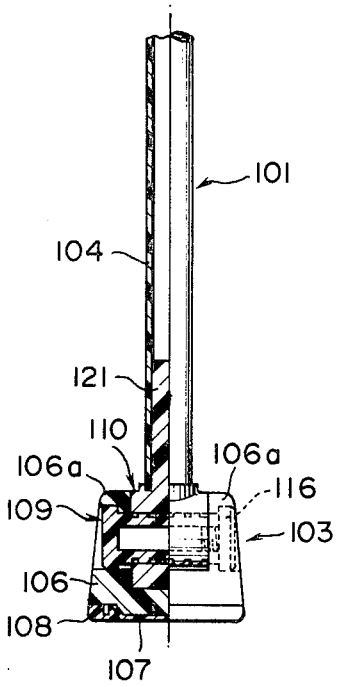
FIG. 22 is a partial cross section along line I—I of FIG. 21.

FIG. 21 and FIG. 22 show a second embodiment. In this embodiment the mop carrier is shown comprising a mop stem generally indicated by the numerals 101, a mop carrier frame 102 and the rotary motion regulator 103 rotatably connecting members 101 and 102 with a certain torque. The mop stem 101 comprises, for example, light metal such as aluminum or alloy or iron or natural or synthetic resin made into a pipe 104 and a grip 105 made of synthetic rubber, as in the first embodiment.

The mop carrier 102 comprises a main body made of synthetic resin or metal, an engagement fastener or tape 107 attached on the bottom face of the main body, for holding the mop, and a retaining ring 108 for securing the fastener 107 on the main body.

The rotary motion regulator 103 comprises essentially the axial pin member 109 and the ring member 110.

Figure 23A:
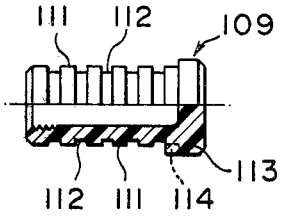
FIG. 23A is a partial cross section of the bearing pin member of the second embodiment.
Figure 23B:
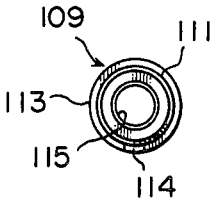
FIG. 23B is a rear elevation view thereof.
Figure 24A:
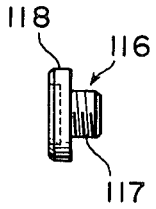
FIG. 24A is a side elevation view of an axial cap for the bearing pin member of FIG. 23A.
Figure 24B:
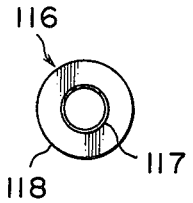
FIG. 24B is a rear elevation view thereof.
Figure 24C:
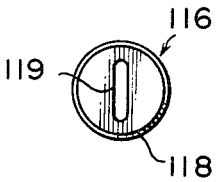
FIG. 24C is a front elevation view thereof.

FIGS. 23A and 23B show the axial pin member 109 having a plurality of circumferential projections 111 provided axially at a certain spacing from each other and having one or more circumferential grooves 112 provided between the projections. Provided at one end of the axial member 109 is a head 113 having a diameter larger than the circumferential projections 110, and an engagement projection 114 is provided inside of the head 113 so as to engage the axial member 109 non-rotatably with respect to the main body 106 (see FIGS. 21 and 22) of the mop carrier frame. The axial member 109 may be a bar, but more preferably it is a hollow, tubular member as shown in FIGS. 23A and 23B in order to suppress the rotary torque to a constant degree.

Provided at the other end of the axial pin member 109 along the inner wall of this hollow part are female threads 15 with which an axial cap 116 shown in FIGS. 4A–C is threadedly mated. The axial cap 116 comprises a head 118 which is provided with a screwdriver blade-accepting slot 109.

Figure 25A:
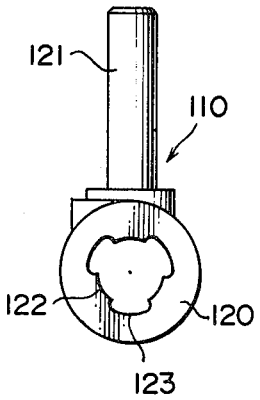
FIG. 25A is a left side elevation view of the annular ring member of the second embodiment for comparison with FIG. 14.
Figure 25B:
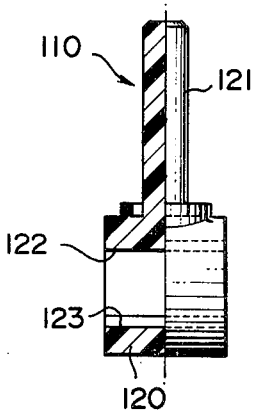
FIG. 25B is a partial cross section of the annular ring member.
Figure 25C:
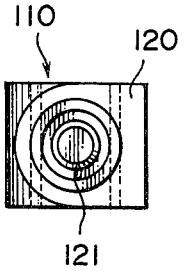
FIG. 25C is a top plan view of the annular ring member.

The ring member 110 shown in FIGS. 25A–25C comprises a boss 120 integrally provided therewith and a projection 121 to be received into a corresponding socket the lower end of the mop handle (FIG. 21). Provided in the interior space of the boss 120 of the ring 110 are a plurality of longitudinal projections 122 provided equiangularly about the circumference of the bore of the boss and grooves 123 provided between these projections 122.

Figure 26A:
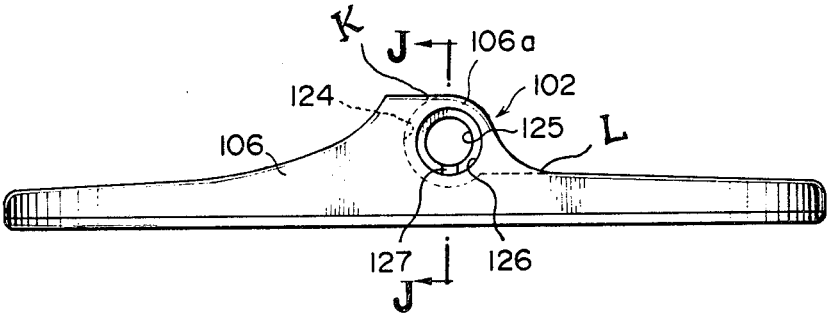
FIG. 26A is a left side elevation view of the mop carrier of the second embodiment.
Figure 26B:
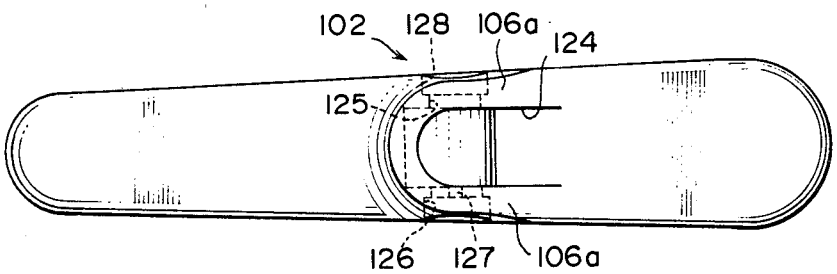
FIG. 26B is a top plan view thereof.
Figure 26C:
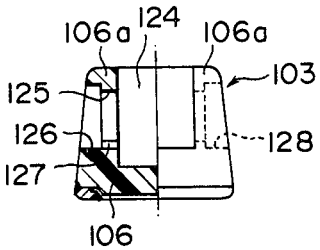
FIG. 26C is a partial longitudinal cross section along line J—J of FIG. 26A.

The mop carrier frame 102 shown in FIGS. 23A–C has a recess 124 for receiving the boss 120 of the ring 110. The recess 124 opens throughout an angle of about 90° from a position K to a position L shown in a left-to-right side FIG. 26A. Provided in lateral direction of the carrier frame 102 is a bore 125 for inserting the axial pin member 109, and provided at one end of the opening end of the bore 125 are a notch 126 for receiving the head 113 of the axial pin member 109, another notch 127 for engaging the engaging projection of the axial member 109. At the opposite end of the bore 125 is provided a further notch 128 for receiving the axial cap 116. The bore 125 intersects the recess 124 intermediate the ends of the bore, thereby providing left and right bearing barrels 106*a* on the carrier frame 102.

When assembling the mop stem 101 and the carrier frame 102, the ring 110 connected with the stem 101 is inserted in the recess 124 of the carrier frame 102, and then, the axial pin member 109 is inserted within the bore of the ring 110 from the bore 125 of the mop carrier frame. Then, the engagement projection 114 of the axial member 109 engages with the engagement notch 127 of the carrier frame 102, and the axial cap 128 is inserted from the notch 116 of the carrier frame 102 thereby threadably mated with the axial pin member 109. Thus, the axial pin member 109 is non-rotatably secured to the mop carrier frame 102, while the mop stem 101 is rotatably joined with the mop carrier frame 102.

The feature of the rotary movement regulator is based on a fact that rotary torque is suppressed to a constant range by a fact that a plurality of the projections 111 provided on the axial member 109 and a plurality of the projections 122 on the ring member 110 are mutually frictionally engaged. During assembly, the circumferential projections 111 on the axial pin member 109, because of the circumferential recesses 112, and the projections 122 on the ring member, because of the recesses 123, a sufficient bending is applied on the both projections 111 and 122 where the axial pin member 109 and the ring member 110 comes in frictional engagement not only to provide the rotational torque regulation therebetween at a certain range but also to prevent a fluctuation of the rotary torque and wear or breakage of these members during the long usage. Furthermore, the projections 111 and the grooves 112 on the axial pin member 109 of this embodiment are so provided in series, while the projections 122 and the grooves 123 are so provided in series circumferentially on the ring member 110, that the frictional abutting portions of the axial pin member 109 and the ring member 110, i.e. the projections 111 and 122 are bendable, whereby the merit of said suppression of the rotary torque, the prevention of the fluctuation of the rotary torque, the wear of the parts, etc., is more notably achieved. Additionally, because the projections 111, 112 of the both members of this embodiment are bendable, an insertion of the axial member 109 into the ring member 110 is easily made.

Still another merit of this invention resides in a setting of the rotary torque at 0.49–0.9 kg cm, more preferably 0.49–0.7 kg cm between the axial pin member 109 and the ring member 110, relative to the employment of the mating and the frictional mating of the axial pin member 109 and the ring member 110 as mentioned heretofore. By setting the torque at that value, the mop carrier frame is comfortably and rotatably but not excessively jointed with the mop stem and as a result, the user can sweep the floor with the mop deployed below the stem, the mop always rotating relative to the mop handle so that it faces the floor.

The axial pin member 109 and the ring member 110 are designed in a size and a shape so as to keep the rotary torque at the value mentioned.

The circumferential projections 111 may have a same diameter along the whole body as shown in FIG. 23A, or may be cylindrical, ellipsoidal, U-shaped, V-shaped, or trapezoidal in an axial direction.

The innermost surface of the projections 122, considered collectively, is preferably generally discontinuously cylindrical.

The axial pin member 109 and ring member 110 may be formed of any plastic material having a sufficient flexibility and strength, such as a synthetic resin, synthetic rubber or metal. However, they are preferably made of polypropylene, nylon, actal resin (polyoxymethylene), etc., in the view of suppressing the rotary torque to the desired threshold value range.

The circumferential projections 111 of the axial pin member should have an outer diameter ($D_1$) which is equivalent to or slightly larger than an inner diameter ($D_2$) of the projections 122 of the ring member 110, so as to suppress the torque to the desired degree.

Since the mop carrier frame and the mop stem are not connected in a thrust direction but the axial member and the ring member are frictionally mated, so as to rotate to a certain threshold rotary torque, a wider scope of mopping and sweeping is surely achieved and wear of the parts is prevented.

We claim:

1. A mop carrier assembly, comprising:

a carrier frame including an upper base frame member, and a lower inner base plate member secured therewith so as to have a bottom surface thereof presented downwardly, said carrier frame including means for mounting the carrier frame to a mop handle;

a layer of a first hook and fleece-type fastener member disposed upon said bottom surface and presented downwardly; and a support frame secured to said carrier frame with said first fastener member therebetween, with said first fastener member downwardly being largely exposed.

2. The mop carrier assembly of claim 1, wherein:

said inner base plate member is generally elongated ellipsoidal in plan and generally convex downwardly, but includes means defining a plurality of downwardly-opening side-to-side grooves in said bottom surface;

means providing a plurality of upwardly-projecting pins upon said inner base plate member superjacent opposite ends of said grooves; and means providing a plurality of downwardly-opening sockets in said bottom surface within said grooves adjacent opposite ends of said grooves;

said pins connecting said inner base plate member with said upper base frame member, and said sockets connecting said support frame with said carrier frame.

3. The mop carrier assembly of claim 2, wherein:

said first fastener member has means providing holes therethrough in locations corresponding to those of said sockets so that said support frame may be connected to said carrier frame through said first fastener member.

4. The mop carrier assembly of claim 2, wherein:

said support frame includes an elongated generally ellipsoidal border portion with a plurality of traversing bridge portions provided in locations corresponding to those of said grooves in said bottom surface of said inner base plate member; and means providing a plurality of upwardly projecting pins on said support frame in locations corresponding to those of said sockets of said inner base plate member, so that as said support frame is assembled to said carrier frame, said bridge portions become disposed in said grooves and the last-mentioned said pins are securingly-received in said sockets.

5. The mop carrier assembly of claim 4, wherein:

said first fastener member has means providing holes therethrough in locations corresponding to those of said sockets so that said support frame may be connected to said carrier frame through said first fastener member.

6. The mop carrier assembly of claim 1, wherein:

said layer of a first hook and fleece-type fastener member is constituted by a layer of hook fasteners, whereby the mop carrier assembly is equipped to removably mount a mop backed with a second hook and fleece-type fastener member constituted by a layer of fleece fasteners.

7. The mop carrier assembly of claim 1, further comprising:

a mop handle stem member having boss means providing a bearing barrel at the lower end thereof, said bearing barrel having means providing a generally horizontal throughbore extending side-to-side and having means defining an internal surface of said bore;

said mop handle stem member including a stem portion projecting generally radially outwardly of said bearing barrel boss means; and pin means secured to said carrier frame through said bearing barrel boss means bore, thereby pivotally joining said carrier frame to said mop handle stem member.

8. The mop carrier assembly of claim 7, further comprising:

a pair of aligned bearing barrels on said upper base frame member;

said handle stem member bearing barrel boss being coaxially received between said upper base frame member bearing barrels; and said pin means being assembled to said upper base frame member bearing barrels through said handle stem member bearing barrel bore; and means engaging on said pin means and said upper base frame member bearing barrels for preventing rotation of said pin means relative to said upper base frame member while said handle stem member is pivotally joined to said carrier frame by said pin means.

9. The mop carrier assembly of claim 8, further including:

a mop handle having a downwardly opening socket; and said mop handle stem being securely received in said mop handle socket.

10. The mop carrier assembly of claim 8, further comprising:

surface means on said pin means frictionally engaging said surface means of said handle stem member bearing barrel bore for elevating the threshold of the amount of rotary torque needed for rotating the mop carrier frame, when a mop is assembled therewith, relative to the mop handle stem.

11. The mop carrier assembly of claim 10, wherein:

said threshold amount of rotary torque lies in the range of 0.45–0.90 kg cm.

12. The mop carrier assembly of claim 10, wherein:

said pin means comprises a series of angularly spaced axial ridges interspersed with axial grooves to provide said surface means thereof; and said handle stem member bearing barrel bore comprises a series of circumferential ridges interspersed with circumferential grooves to provide said surface means thereof.

13. The mop carrier assembly of claim 1, further including:

interdigitated perimetrical ridge and groove means formed on said upper base frame member and said lower inner base plate member;

said ridge and groove means including wall means connected with one another for securing said upper base frame member to said lower inner base plate member.

* * * * *